US005726621A

United States Patent [19]

Whitney et al.

[11] Patent Number: 5,726,621

[45] Date of Patent: Mar. 10, 1998

[54] CERAMIC CHIP FUSES WITH MULTIPLE CURRENT CARRYING ELEMENTS AND A METHOD FOR MAKING THE SAME

[75] Inventors: Stephen Whitney, Manchester; Keith Spalding, Fenton; Joan Winnett; Varinder Kalra, both of Chesterfield, all of Mo.

[73] Assignee: Cooper Industries, Inc., Houston, Tex.

[21] Appl. No.: 514,088

[22] Filed: Aug. 11, 1995

Related U.S. Application Data

[63] Continuation-in-part of Ser. No. 302,999, Sep. 12, 1994, Pat. No. 5,440,802.

[51] Int. Cl.[6] ..... H01H 85/04

[52] U.S. Cl. ..... 337/297; 337/292; 337/283

[58] Field of Search ..... 337/297, 227, 337/228, 188, 283, 292, 293, 414, 416; 29/623

[56] References Cited

U.S. PATENT DOCUMENTS

| | | | |
|---|---|---|---|
| 4,300,115 | 11/1981 | Ansell | 338/314 |
| 4,991,283 | 2/1991 | Johnson | 29/595 |
| 5,128,749 | 7/1992 | Hornback | 174/258 |
| 5,224,261 | 7/1993 | Morrill | 29/623 |
| 5,312,674 | 5/1994 | Haertling | 428/773 |
| 5,378,927 | 1/1995 | McAllister | 257/773 |
| 5,408,053 | 4/1995 | Young | 174/264 |
| 5,432,378 | 7/1995 | Whitney | 337/297 |
| 5,440,802 | 8/1995 | Whitney | 337/297 |
| 5,475,262 | 12/1995 | Wang | 257/698 |
| 5,560,851 | 10/1996 | Thimm | 219/543 |

*Primary Examiner*—Leo P. Picard
*Assistant Examiner*—Jayprakash N. Gandhi
*Attorney, Agent, or Firm*—Burns, Doane, Swecker & Mathis, L.L.P.

[57] ABSTRACT

A subminiature circuit protector includes a plurality of layers of ceramic material in a laminate structure, each layer bearing a fuse element. The ends of laminate structure are coated with electrically conductive end terminations. The fuse elements of the layers may be connected in parallel, with fuse elements on each layer connecting to both end terminations, or interconnected in series from one end termination to the other. Each of the fuse elements of the individual layers may comprise two or more individual fuse elements connected in series or in parallel. A method for manufacturing the circuit protector in accordance with the invention includes the steps of printing a multiplicity of fuse elements on a plurality of substrates, stacking the substrates to form a laminate structure, cutting the laminate into individual units, and coating the opposite ends of the units with electrically conductive material to form end terminations.

26 Claims, 7 Drawing Sheets

CERAMIC CHIP FUSES WITH MULTIPLE CURRENT CARRYING ELEMENTS AND A METHOD FOR MAKING THE SAME

The present application is a continuation-in-part of U.S. patent application Ser. No. 08/302,999, issued as U.S. Pat. No. 5,440,802, on Sep. 12, 1994.

FIELD OF THE INVENTION

The present invention relates to subminiature surface mounted circuit protectors. More particularly, the present invention relates to ceramic chip circuit protectors having multiple current carrying elements. The invention also relates to a method for manufacturing a ceramic chip circuit protectors in accordance with the present invention.

BACKGROUND AND SUMMARY OF THE INVENTION

Subminiature circuit protectors are useful in applications in which size and space limitations are important, for example, on circuit boards for electronic equipment, for denser packing and miniaturization of electronic circuits. Subminiature circuit protectors, or chip fuses, have a smaller footprint than other types of fuses and generally require less horizontal space or "real estate" on the circuit board than conventional fuses.

As voltage and current requirements for a fuse increase, typically a fuse of greater size, in length and diameter, must be provided to meet the needed capacity. In such cases, size and space problems in circuit boards and other similar applications may be exacerbated.

The present invention, generally, provides a subminiature surface mountable circuit protector for high voltage and/or high current use that is compact and small in size. The present invention also provides a method of manufacturing a surface mountable circuit protector that is simple and relatively inexpensive.

More particularly, the present invention provides a subminiature surface mountable fuse that comprises a plurality of layers of ceramic substrate, with a fusible element disposed on surfaces of at least some of the layers. The fusible elements may be interconnected in series or in parallel depending on a desired voltage and/or current carrying capacity of the fuse.

According to one aspect of the invention, at least some layers of a fuse have a single fuse element thereon. Alternatively, fusible elements are provided on at least some layers of a fuse and comprise two or more fusible elements interconnected in series. A plurality of layers of series connected fusible elements may be connected in parallel to form a single chip fuse.

In another alternative aspect of the invention, the fusible elements may comprise two or more fusible elements connected in parallel. A plurality of layers of connected fusible elements may be connected in series in a single chip fuse.

According to a method of the present invention, a substrate plate of green, or unfired, ceramic material is prepared. Electrically conductive metallic film is deposited on a top surface of the substrate plate in equally spaced, preferably parallel columns. Fuse elements, in the form of a electrically conductive film, are disposed on the top surface of the substrate in a direction substantially transverse, and preferably perpendicular to a direction of the film columns, in equally spaced, preferably parallel rows. A plurality of substrates thus prepared are positioned in a stack with the columns and rows aligned to form a laminate structure. A cover of green ceramic material is laminated to a top substrate. The formed structure is then cut by a suitable method, preferably longitudinally through the metal film columns and preferably transversely between the fuse element rows so that individual chip fuse units are produced having strips of metal film at opposite ends and a fuse element extending from end to end across a space between the metal film strips. The individual units are fired to cure the ceramic substrate layers and cover and to cause a metallic bond to form between the fuse elements and the metal film. The ends of the individual units are ordinarily coated with electrically conductive materials to form electrical terminations for connecting the fuse elements.

According to another aspect of the invention, the individual chip fuse units have opposite ends faces and opposite lateral faces. The laminate structure is cut so that a metal strip at each opposite end of each unit extends to the end face and to both lateral faces so that the electrical termination coatings that are ordinarily applied to the units contact the metal strips on the end and lateral faces. This configuration connects the fuse elements to form a parallel configuration.

According to another aspect of the invention, holes are formed by a suitable method, such as by punching, or by being formed with a laser or water jet, in the green ceramic substrate at predetermined locations. The holes are metallized, that is, electrically conductive metal is disposed in the holes by a vacuum drawing method or other suitable technique. Electrically conductive film is deposited on the surface of a substrate in a column of separate pads, so that pads contact predetermined metallized holes. Fuse element material is deposited to connect two pads. Alternatively, the fuse element material is deposited first, and the film is deposited afterwards, or the fuse element material and film are deposited together. A laminate structure is made of a plurality of substrates overlaid so that pads and fuse elements of stacked layers are in alignment. The laminate structure is cut so that a pattern of pads, fuse elements and metallized holes form an electrical pathway. The cut individual units are fired to cure the ceramic substrate and cover plate and to cause a metallic bond to form between the metallized holes, fuse elements and the metal film at areas of mutual contact. The ends of the individual units are ordinarily coated with electrically conductive materials to form electrical terminations for completing a series circuit in each fuse.

According to yet another aspect of the invention, the end termination coatings comprise a first coating of silver or a silver alloy, or other suitable alloy, such as a silver/tin alloy, or a paladium/nickel alloy. A second coating of nickel is applied over the first coating. A third coating of a tin/lead alloy is applied over the nickel coating.

BRIEF DESCRIPTION OF THE DRAWING FIGURES

The present invention can be further understood with reference to the following description in conjunction with the appended drawings, wherein like elements are provided with the same reference numerals. In the drawings:

FIG. 1 is a perspective view of a circuit protector according to the present invention;

FIG. 2*a* is a sectional view of the circuit protector of FIG. 1 taken along line 2—2 illustrating a first embodiment of the circuit protector in accordance with the invention;

FIG. 2*b* is a sectional view of corresponding to the view of FIG. 2*a*, illustrating an alternative embodiment of a circuit protector according to the invention;

DETAILED DESCRIPTION OF PREFERRED EMBODIMENTS

Figure 1:
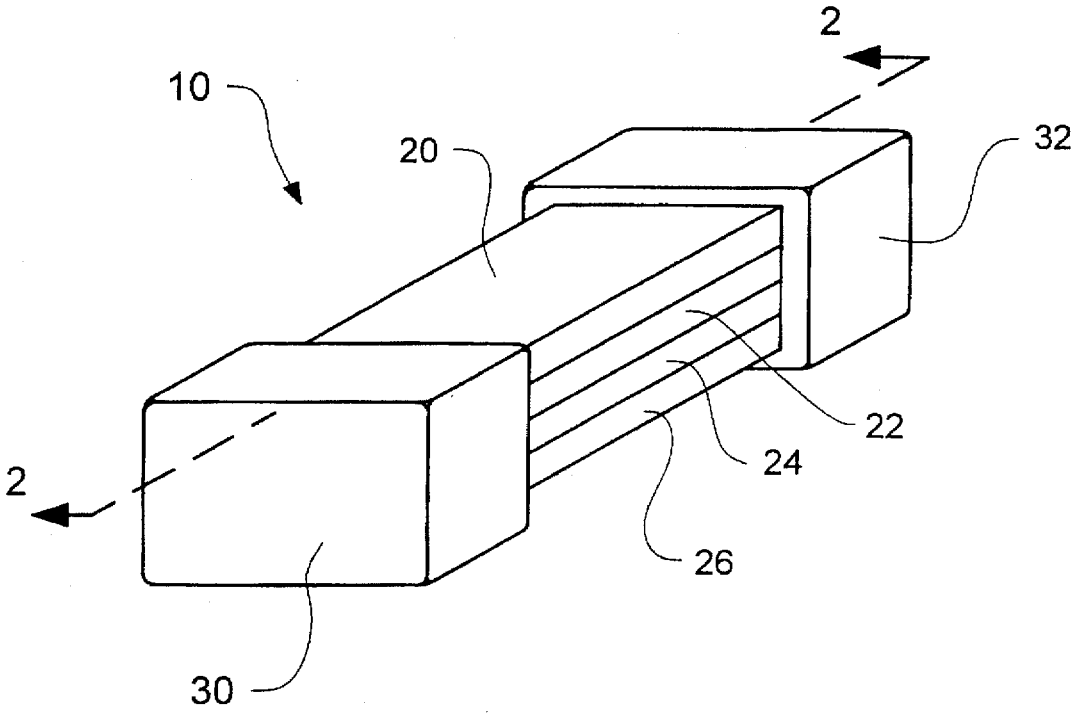

FIG. 1 is a perspective view of a subminiature circuit protector 10, or chip fuse, according to the present invention. The chip fuse 10 is not shown to scale, and the size and thickness of various components of the fuse 10, further described and illustrated below, are exaggerated for clarity of the illustration.

The fuse 10 includes an upper layer or cover 20, a bottom layer 26 and intermediate layers 22 and 24. The layers 22–26 and cover 20 are laminated together to form a chip structure. End terminations 30, 32 are preferably provided at opposite ends of the fuse 10 electrically connect with the interior components of the fuse 10, not illustrated in this figure. The end terminations 30, 32 also allow the fuse 10 to be connected in an electric circuit.

Although the fuse 10 in FIG. 1 is shown with a cover 20 and three lower layers 22, 24 and 26, the number of layers shown is illustrative rather than limiting. As will be understood by the following description, a fuse in accordance with the present invention may include a cover and a plurality of layers, although a fuse may also include a cover and one layer.

According to one aspect of the invention, each of the layers below the cover 20 carries at least one fusible element. The fusible elements may be connected in series, in parallel, or in a combination series and parallel, as further described below.

Figure 2A:
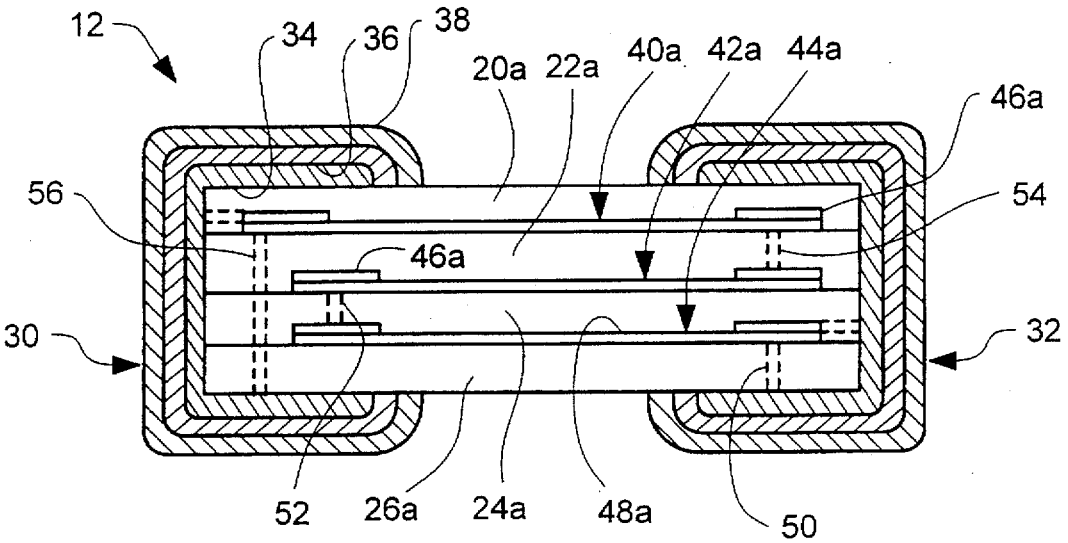
Figure 3:
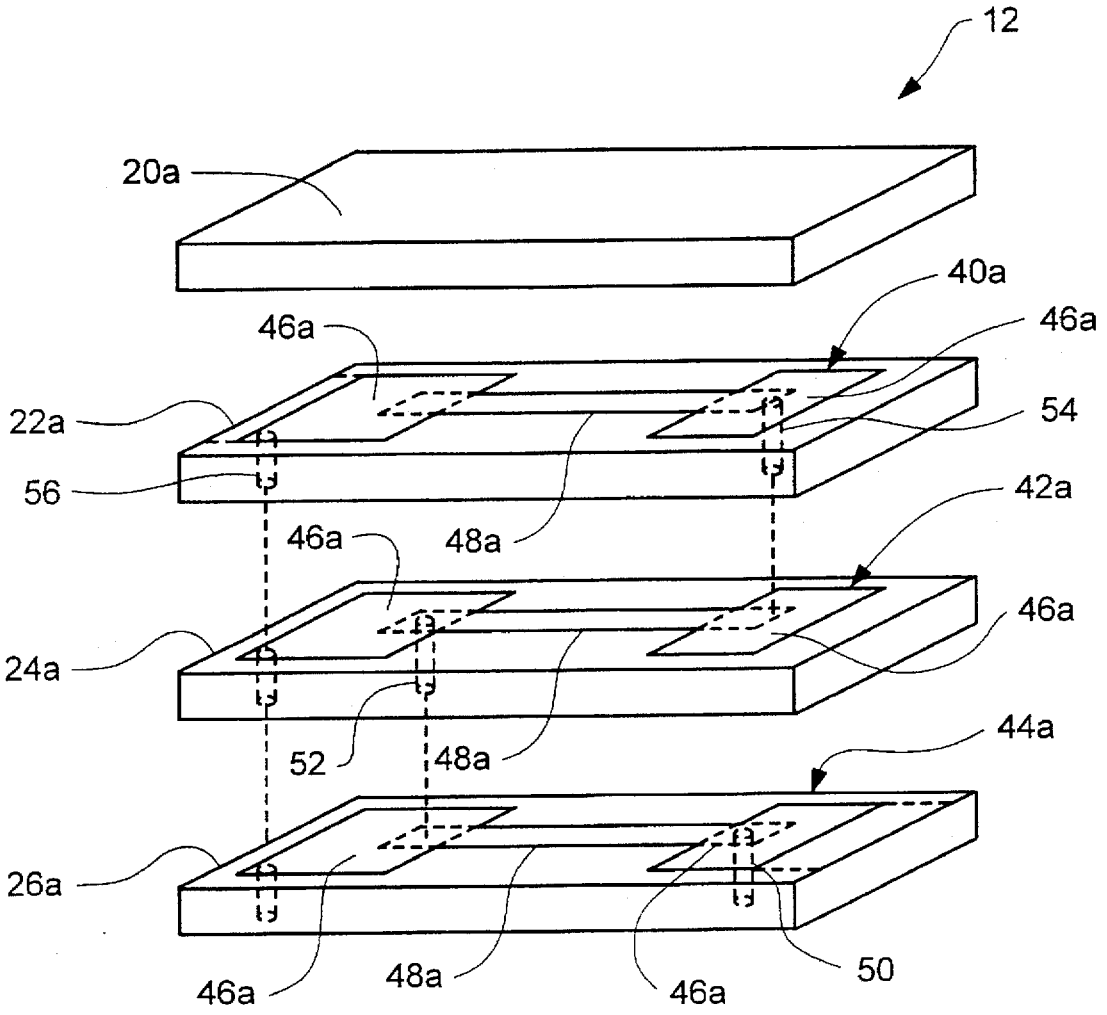
FIG. 3 is an exploded view of a circuit protector according to the invention.

FIG. 2*a* illustrates a first embodiment 12 of the fuse of the invention in which the fusible elements are connected in series. FIG. 2*a* is a sectional view taken along the line 2—2 of FIG. 1. FIG. 3 is an exploded view of a chip fuse 12 having fusible elements connected in series. The following description refers to both figures.

As may be seen, each layer 22*a*, 24*a* and 26*a* includes a fusible element 40*a*, 42*a* and 44*a*, respectively. The fusible elements 40*a*, 42*a*, 44*a* are interconnected and are preferably connected to the end terminations 30, 32 by vias 50, 52, 54 and 56 to form a series connection from one end termination 30 to the other end termination 32. The vias 50–56 are holes formed in each layer at predetermined locations and metallized, that is, filled with an electrically conductive metal. As may be seen with attention to FIG. 3, according to one embodiment of the invention, the fusible elements 40*a*, 42*a*, 44*a* are contained within each respective layer 22*a*, 24*a*, and 26*a*, and do not contact the end terminations 30, 32 except through the vias 50 and 56, which are connected to the uppermost 40*a* and lowermost 44a fusible elements. However, according to another embodiment, if desired or necessary, instead of using the vias 50 and 56 in the embodiment shown in FIG. 2*a*, the pads 46*a* may extend directly to the end terminations 30 and 32 as shown by dotted lines in FIGS. 2*a* and 3. The fuse elements may or may not extend to the end terminations as shown in FIG. 2*a* as desired or necessary. Further still, the end terminations 30, 32 may be wholly omitted and the vias 50 and 56 or pads 46a that extend to ends of the substrate may be connected directly in the circuit in which the chip fuse is used.

As best seen in FIG. 3, each of the fusible elements 40*a*, 42*a* and 44*a* is formed with spaced apart, enlarged pad portions 46a connected by a narrow strip 48*a*. The narrow strip 48*a*, or fuse element, is a thin film of metallic material selected for responsiveness to voltage and/or current. The pad portions 46*a* comprise a film of metallic material preferably somewhat larger than the fuse element 48*a*, although the pad portions and the fuse element may be applied in a single print which would result in those elements being the same thickness.

As seen in FIG. 2*a*, the fuse element 48*a* is applied beneath, i.e., before the pad portions 46*a*. However, fuse elements according to the present invention may be applied at the same time as the pad portions, i.e., in a single print, as seen in FIG. 3, or before or after the pad portions, as shown by dotted lines in FIG. 3.

As seen in FIG. 2*a* and FIG. 3, the chip fuse 12 may have a functional fuse element having a length that is the addition of the lengths of the fuse elements 48*a* of the individual layers 22*a*, 24*a*, and 26*a*. The chip fuse 12 thus is shorter and more compact than a conventional fuse having the same voltage rating.

Figure 2B:
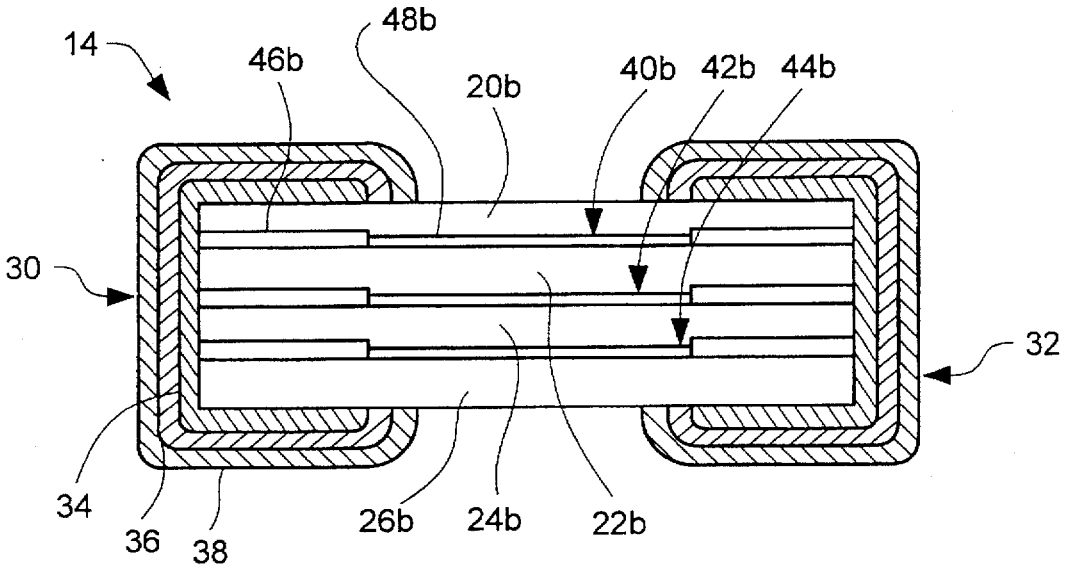

FIG. 2*b* illustrates a second embodiment of a fuse chip 14 having fusible elements connected in parallel, rather than in series as in FIG. 2*a*. Each of the layers 22*b*, 24*b*, and 26*b* carries a fusible element 40*b*, 42*b*, 44*b*. The fusible elements 40*b*–44*b* each include pads 46*b* at opposite end portions connected by a thin fuse element 48*b*. The pads 46*b* extend to the ends of each layer 22*b*, 24*b*, 26*b*, to contact the adjacent end terminations 30, 32 at the opposite ends of the chip fuse 14. The pads 46*b* may also extend laterally to lateral edges of each layer to contact the portion of the end terminations covering the lateral edges, thus making contact with the end terminations 30, 32 on three sides.

As shown in FIG. 2*b*, each of the fusible elements 40*b*, 42*b*, 44*b* of each layer is connected with both of the end terminations 30, 32. The chip fuse 14 therefore has a plurality of parallel connected fuse elements. The fuse chip 14 of FIG. 2*b* may thus be configured for higher current carrying capacity because of the multiple parallel current pathways.

In each of the chip fuses 12 and 14, the end terminations 30, 32 are preferably formed of three layers of electrically conductive material. A first, or inner layer 34, comprises a coating of silver or a silver alloy. A second layer 36 comprises nickel and a third layer 38 comprises a layer of tin/lead alloy that facilitates connecting the fuse in an electrical circuit by soldering or other suitable means. Other suitable materials may, of course, be used as desired or necessary. Also, the end terminations 30, 32 may be wholly omitted and the chip fuses may be connected to a circuit directly to the vias 50, 56 or pads 46*a* or 46*b* extending to the ends of the substrates. Further, if desired or necessary, the chip fuses may be provided with, for example, a coating of silver or a silver alloy proximate the ends of the chip fuses such that the coating contacts the vias or the pads, and the chip fuses may be inserted in a socket or a clip for connection to an electrical circuit.

Figure 4:
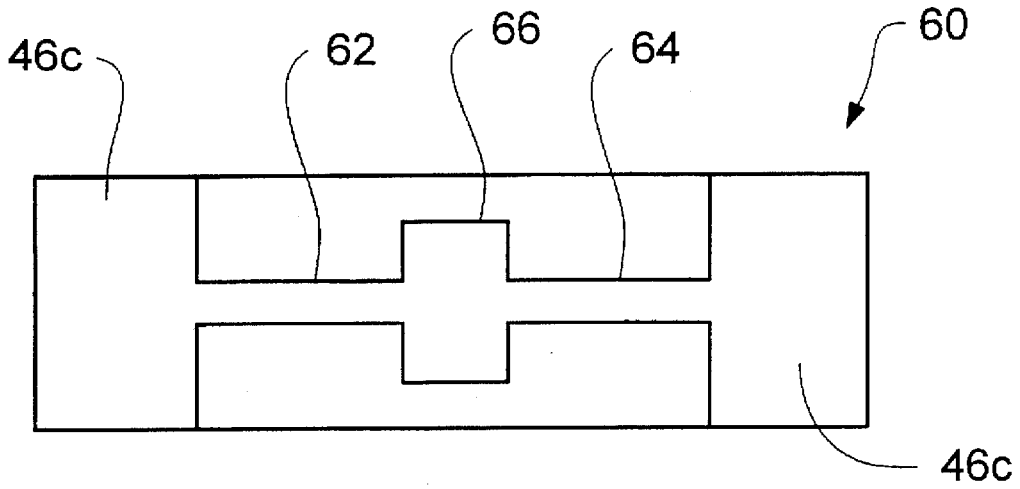
FIG. 4 is a top view of a substrate layer having two fuse elements in series.

FIG. 4 is a top view of a substrate layer 60 for a chip fuse according to an alternative embodiment of the invention.

The fusible element is formed thereon as two fuse elements 62, 64 connected in series. Pads 46*c* at the opposite ends of the substrate 60 extend to the end edges and both lateral edges of the substrate layer. A third pad 66 is disposed on the substrate 60 substantially centrally. The two fuse elements 62, 64 connect to the end pads 46c and center pad 66 to form the two fusible elements in series. A plurality of substrate layers 60 may be laminated in a single chip fuse in the manner illustrated in FIG. 2*b*, that is, for parallel connection of the fuse elements of each layer. A chip fuse having substrate layers 60 thus has a combination of series and parallel connections.

Figure 5:
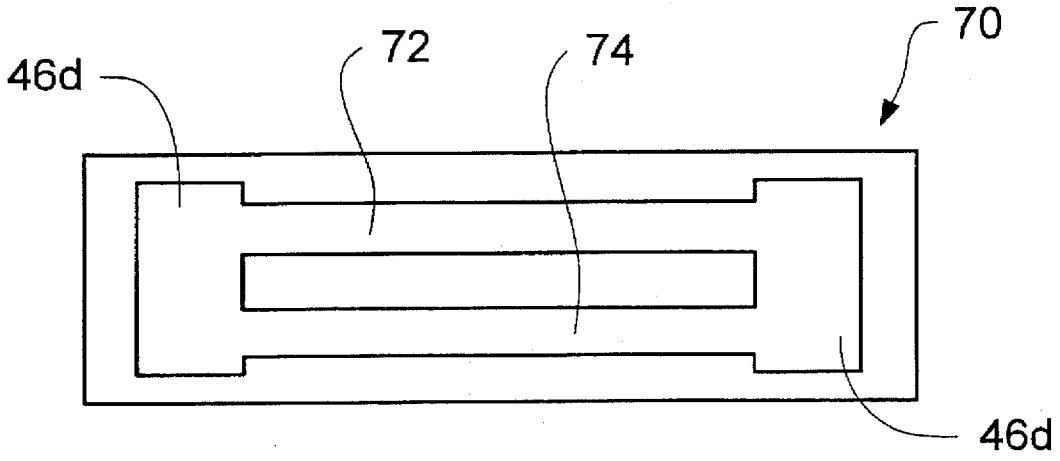
FIG. 5 is a top view of a substrate layer having two fuse elements in parallel.

FIG. 5 is a top view of another alternative embodiment of a substrate layer 70. Pads of electrically conductive film are disposed on the opposite end portions of the substrate 70. Two fusible elements 72 and 74 are deposited on the upper surface of the substrate 70 in parallel and connect to both of the pads 46*d*. The substrate layers 70 are formed with metallized holes in predetermined locations as described in connection with FIG. 2*a*. A plurality of substrate layers 70 may be assembled in the manner described in connection with FIG. 2*a* to form a chip having a combination parallel and series fuse connections.

Figure 6:
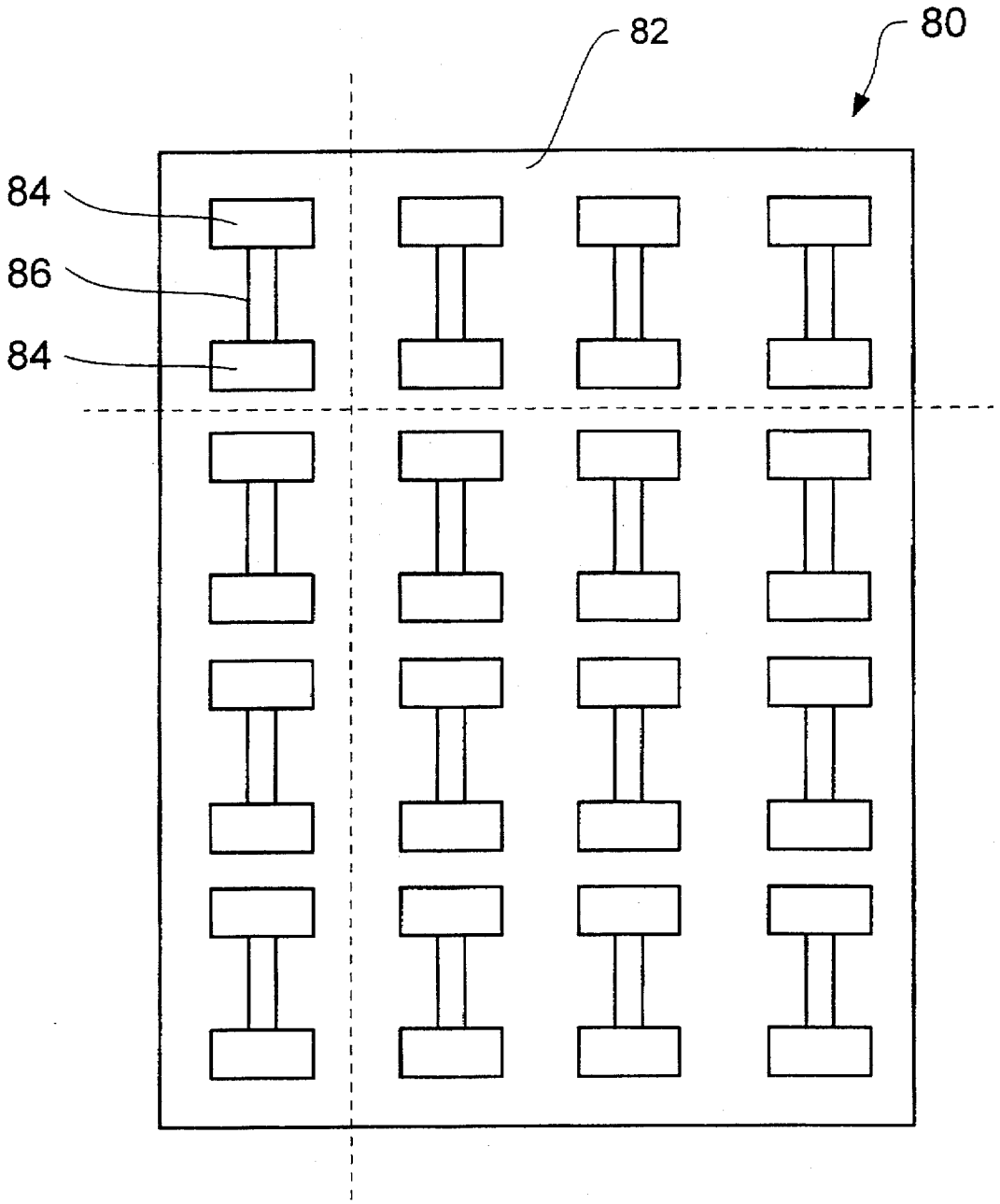
FIG. 6 is a top view of a substrate plate illustrating a depositing method for the circuit protector of FIG. 2*a*.
Figure 7:
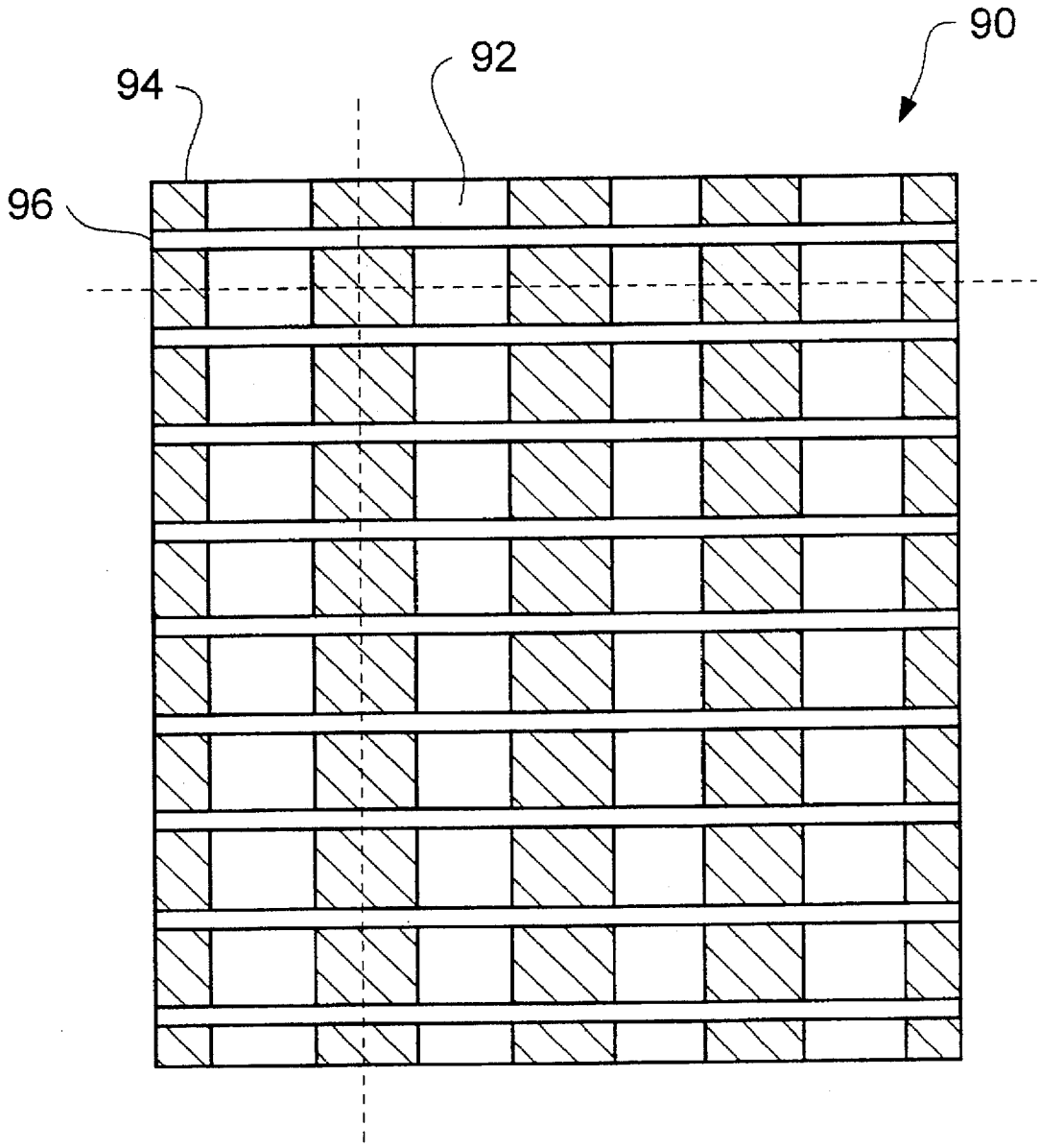
FIG. 7 is a top view of a substrate plate of illustrating a depositing method for the circuit protector of FIG. 2*b*.

FIGS. 6 and 7 illustrate a method of manufacturing the fuses 12, 14 of the present invention. FIG. 6 relates to the chip fuse 12 described in connection with FIG. 2*a*, and FIG. 7 relates to the chip fuse 14 described in connection with FIG. 2*b*. The method permits the manufacture of a multiplicity of individual fuses starting with a plurality of substrate layers.

Referring to FIG. 6, a substrate layer 80 of green, or unfired, ceramic material having an upper surface 82 is provided. A multiplicity of pads 84 and fuse elements 86 are deposited on the upper surface 82 in spaced relationship. The fuse elements 86 connect two adjacent pads to form a fusible element for the individual substrate layers, as previously described. The pads and fuse elements may be deposited in individual steps or simultaneously in a single step by screen printing or another suitable method. The substrate layer 80 may also be printed with a multiplicity of fuse elements 72, 74, and pads 46*d*, illustrated in FIG. 5. A plurality of substrate layers 80 are prepared to provide, for example, layers 22*a*, 24*a*, 26*a* as shown in FIG. 2*a* and FIG. 3. The individual layers are punched to place holes for the metallized vias 50–56 to interconnect the fuse elements of the layers. As may be understood by reference to FIG. 3, different patterns of holes are punched in a substrate layer depending on which the position the layer will take in the formed chip fuse to facilitate the interconnecting of the fuse elements.

The holes may be metallized by drawing a paste of electrically conductive metal through the holes by vacuum, or by another suitable method. The holes are preferably punched and metallized before the pads and fuse elements are deposited on the substrate layer, although the pads and fuse elements may be put on prior to forming holes and metallizing the holes or prior to metallizing formed holes.

A plurality of substrate layers 80 is assembled in a stack, and positioned so the pads 84 and fuse elements 86 are positioned in overlaying relationship as suggested by the single chip fuse in FIG. 3. A cover layer of green ceramic is applied to a top one of the substrate layers. The cover layer of green ceramic may be applied before or after the assembled substrate layers are bonded together. The assembled structure is then cut or diced into individual units, in the manner indicated by the broken lines in FIG. 6, so that each unit contains a plurality of fuse elements in a stack.

A steel rule die, or other suitable tool, is preferably used to cut the laminate structure into individual units. Cutting the laminate structure is facilitated by the unfired condition of the ceramic cover and substrate layers 80, which are relatively soft and easily cut in that state. The cutting operation is thus performed with lower power than in conventional ceramic chip methods, resulting in lower costs. In addition, because green ceramic is less brittle than fired ceramic, there is less loss due to cracking and breaking of the ceramic during the cutting operation.

The individual units are then fired as is known in the art to cure the ceramic material. During firing, the heat causes a metallic bond to form between the vias 50–56 and the metal film pads 46*a*, creating a reliable electrical connection.

The individual units are then coated with end terminations to form the fuse 10 shown in FIG. 1 and FIG. 2*a*. A coating method according to a preferred embodiment of the invention involves positioning the individual units by conventional vibratory sorting means in a fixture having a multiplicity of holes for holding the units. The units are held in parallel in the fixture, and the opposite end portions at which the pads are disposed are dipped and coated with electrical conducting material in one or more steps.

Referring to FIG. 7, a method of making a fuse chip according to FIG. 2*b* is described. A substrate layer 90 of green, or unfired, ceramic material having an upper surface 92 is provided. Electrically conductive metal film is deposited on the upper surface 92 as a plurality of spaced, preferably parallel columns 94 to provide what will form the end pads 46*b* in the completed chip fuse illustrated in FIG. 2*b*.

Additional conductive metal film is deposited on the upper surface 92 in a plurality of spaced, preferably parallel rows 96, the rows being oriented perpendicular to the columns 94. The rows 96 form, for example, what are the fuse elements 40*b*, 42*b*, 44*b*, in the completed chip fuse shown in FIG. 2*b*. The substrate layer 90 may also be printed with the fuse elements 62, 64, and central pad 66 illustrated in FIG. 4.

A plurality of substrate layers 90 may be assembled in a stack with the columns and rows in the layers being aligned. A cover of green ceramic is applied on an uppermost substrate layer to form an assembled structure. The substrate layers 90 may be pressed together to bond to one another before or after the cover of green ceramic is applied. The substrate layers 90 and the cover 20*b* of green ceramic are preferably bonded together under heat and pressure. The assembled structure is cut or diced as described above, in a pattern as indicated by the broken lines in FIG. 7 to form individual units.

The individual units are fired to cure the ceramic, and the fired units are coated with the end terminations as described above.

Figure 8:
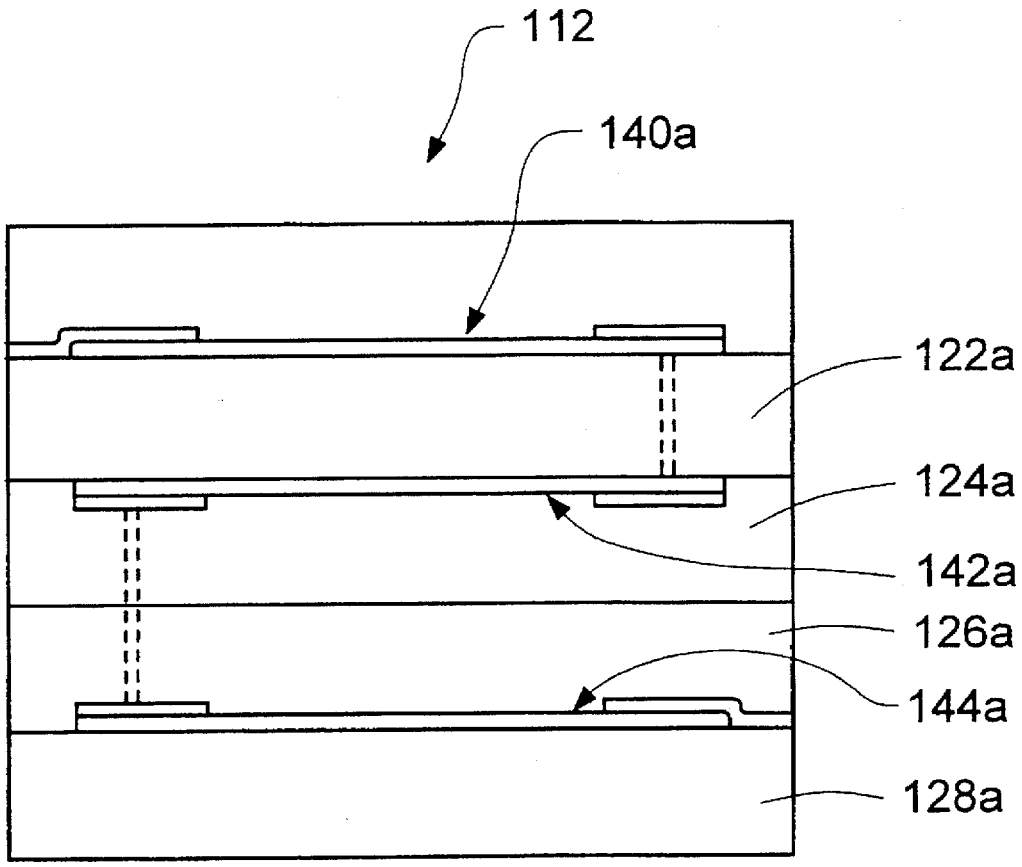
FIG. 8 is a sectional view of a circuit protector according to an embodiment of the present invention.

The present invention is not limited to embodiments wherein a fuse element is disposed on each substrate layer. As seen in FIG. 8, which shows a chip fuse 112 having fuse elements 140*a*, 142*a* and 144*a* connected in series, although the fuse elements may, instead be connected in parallel, a fuse element may be omitted on one or more layers 122*a*, 124*a*, 126*a*, 128*a*, which might be desired, for example, to minimize the possibility of arcing between fuse elements. Moreover, if desired or necessary, a fuse element may be printed on both sides of a single layer 122*a*, 124*a*, 126*a*, or 128*a* which may be desired, for example, to increase the working length of series connected fuse elements, or on a top side of one substrate layer and a bottom side of another layer within the same chip fuse.

In a chip fuse according to the present invention, the end terminations need not cover the entire end of the chip fuse and, in certain circumstances, may be omitted entirely. For example, if desired or necessary, the end terminations may only be provided proximate vias of the chip fuse or proximate pads of the chip fuse that extend to the ends or edges of the substrate on which they are mounted.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. A chip fuse, comprising:

a plurality of substrate layers of ceramic material each having an upper surface, said substrate layers being arranged in a stack having at least an uppermost and lowermost substrate layer;

a fuse element of electrically conductive material disposed on the upper surface of two or more of said substrate layers, each of said fuse elements comprising a pad of electrically conductive material disposed at each of a first and a second end portion of said first substrate, and at least one fusible element electrically connecting said pads;

a cover of ceramic material covering an upper surface of the uppermost substrate layer, wherein said substrate layers and cover form a laminate structure having first and second end portions; and means for electrically interconnecting said fuse elements of the plurality of substrate layers, wherein said means for electrically interconnecting the fuse elements comprises a plurality of conductors each disposed in one of a plurality of holes extending through the substrate layers in predetermined locations to electrically connect the fuse elements of adjacent substrate layers, said means for electrically connecting at least an uppermost fuse element to the end termination at the first end portion comprises a conductor disposed in a hole extending from a pad on the uppermost substrate layer through the uppermost substrate layer and intervening substrate layers to the end termination; and said means for electrically connecting said lowermost fuse element to the end termination at the second end portion comprises a conductor disposed in a hole extending from a pad on said lowermost substrate layer through the lowermost substrate layer to the end termination at the second portion.

2. A chip fuse, comprising:

a plurality of substrate layers of ceramic material each having an upper surface and a lower surface, said substrate layers being arranged in a stack having at least an uppermost and lowermost substrate layer;

a fuse element of electrically conductive material disposed on the upper surface of at least one of said substrate layers;

a fuse element of electrically conductive material disposed on the lower surface of at least one of said substrate layers;

a cover of ceramic material covering an upper surface of the uppermost substrate layer, wherein said substrate layers and cover form a laminate structure having first and second end portions; and means for electrically interconnecting said fuse elements of the plurality of substrate layers.

3. A chip fuse, comprising:

a plurality of substrate layers of ceramic material each having an upper surface, said substrate layers being arranged in a stack having at least an uppermost and lowermost substrate layer;

a fuse element of electrically conductive material disposed on the upper surface of two or more of said substrate layers;

a cover of ceramic material covering an upper surface of the uppermost substrate layer, wherein said substrate layers and cover form a laminate structure having first and second end portions; and means for electrically interconnecting said fuse elements of the plurality of substrate layers.

4. The chip fuse as claimed in claim 3, further comprising:

end terminations of electrically conducting material proximate said first and second end portions of the laminate structure;

means for electrically connecting at least an uppermost fuse element to a first of said end terminations; and means for electrically connecting at least a lowermost fuse element to a second of said end terminations.

5. The chip fuse as claimed in claim 4, wherein on each substrate layer said fuse element extends from a first edge at said first end portion to an opposite second edge at said second end portion of the substrate; and, said end terminations at said first and second end portions electrically connect with said fuse elements on each of said substrate layers, wherein said fuse elements are interconnected by the end terminations.

6. The chip fuse as claimed in claim 5, wherein said fuse elements each comprise a pad of electrically conductive material disposed at each of the first and second end portions of said substrate, said pads extending to at least said first and second edges, and a fusible element disposed between and electrically connecting said pads.

7. The chip fuse as claimed in claim 6, wherein said pads on said substrates each further extend to lateral edges of the first and second end portions.

8. The chip fuse as claimed in claim 5, wherein said fuse elements each comprise a pad of electrically conductive material disposed at each of first and second end portions of the substrate layer, said pads extending to at least said first and second edges, a third pad of electrically conductive material positioned between and separate from the pads at the first and second end portions, a first fusible element disposed between and electrically connecting the pad at said first end portion with said third pad, and a second fusible element disposed between and electrically connecting the pad at said second end portion with said third pad.

9. The chip fuse as claimed in claim 3, wherein each of said fuse elements comprises a pad of electrically conductive material disposed at each of a first and a second end portion of said first substrate, and at least one fusible element electrically connecting said pads.

10. The fuse chip as claimed in claim 9, wherein said means for electrically interconnecting the fuse elements comprises a plurality of conductors each disposed in one of a plurality of holes extending through the substrate layers in predetermined locations to electrically connect the fuse elements of adjacent substrate layers.

11. The chip fuse as claimed in claim 3, wherein each of said fuse elements comprises a pad of electrically conductive material disposed at each of a first and a second end portion of said first substrate, and at least one fusible element electrically connecting said pads, said means for electrically interconnecting the fuse elements comprises a plurality of conductors each disposed in one of a plurality of holes extending through the substrate layers in predetermined locations to electrically connect the fuse elements of adjacent substrate layers, said means for electrically connecting at least an uppermost fuse element to the end termination at the first end portion comprises a conductor disposed in a hole extending from a pad on the uppermost substrate layer through the uppermost substrate layer and intervening substrate layers to the end termination; and said means for electrically connecting said lowermost fuse element to the end termination at the second end portion comprises a conductor disposed in a hole extending from a pad on said lowermost substrate layer through the lowermost substrate layer to the end termination at the second portion.

12. The chip fuse as claimed in claim 11, wherein a bottom surface of the first and second end portions of the lowermost substrate includes a layer of electrically conductive metal to facilitate electrical connection between the conductors and the end terminations.

13. The chip fuse as claimed in claim 4, wherein the end terminations each comprise an inner layer of silver/silver alloy, a middle layer of nickel and an outer layer of tin/lead containing material.

14. The chip fuse as claimed in claim 3, wherein an end of at least one fuse element extends to one of the first and second end portions of the laminate structure.

15. The chip fuse as claimed in claim 3, wherein a fuse element is disposed on the upper surface of each of said substrate layers.

16. The chip fuse as claimed in claim 3, wherein each of said substrate layers has a lower surface, a fuse element being disposed on the lower surface of at least one of said substrate layers.

17. A chip fuse, comprising:

a first substrate of ceramic material having an upper surface;

a first fuse element of electrically conductive material disposed on the upper surface of the first substrate;

a second substrate of ceramic material having an upper surface and disposed on said first substrate;

a second fuse element of electrically conductive material disposed on the upper surface of the second substrate;

a cover of ceramic material covering the upper surface of the second substrate, wherein said first substrate, second substrate and cover form a chip having first and second end portions; and means for electrically connecting the first fuse element and the second fuse element.

18. The chip fuse as claimed in claim 17, further comprising:

end terminations of electrically conducting material proximate said first and second end portions of the chip;

means for electrically connecting said first fuse to the end termination proximate said first end portion; and means for electrically connecting said second fuse to the end termination proximate said second end portion.

19. The chip fuse as claimed in claim 18, wherein said first fuse elements extends from a first edge at said first end portion to an opposite second edge at said second end portion of said substrate;

said second fuse element extends from a first edge at said first end portion to an opposite second edge at said second end portion of the second substrate; and, said end terminations at said first and second end portions electrically connect with said first fuse element and said second fuse element.

20. The chip fuse as claimed in claim 19, wherein said first fuse element comprises a pad of electrically conductive material disposed at each of first and second end portions of said first substrate, said pads extending to at least said first and second edges, and a fusible element disposed between and electrically connecting said pads; and said second fuse element comprises a pad of electrically conductive material disposed at each of first and second end portions of said second substrate, said pads extending to at least said first and second edges, and a fusible element disposed between and electrically connecting said pads.

21. The chip fuse as claimed in claim 20, wherein said pads on said first and second substrates further extend to lateral edges at the first and second end portions.

22. The chip fuse as claimed in claim 17, wherein said first fuse element comprises a pad of electrically conductive material disposed at each of a first and a second end portion of said first substrate, and a fusible element disposed between and electrically connecting said pads; and said second fuse element comprises a pad of electrically conductive material disposed at each of a first and a second end portion of said second substrate, and a fusible element disposed between and electrically connecting said pads.

23. The fuse chip as claimed in claim 22, wherein said means for electrically connecting the first fuse element and the second fuse element comprises a conductor electrically connecting the first fuse element and the second fuse element, said conductor disposed in a hole extending through the second substrate.

24. The chip fuse as claimed in claim 17, wherein said first fuse element comprises a pad of electrically conductive material disposed at each of a first and a second end portion of said first substrate, and a fusible element disposed between and electrically connecting said pads, said second fuse element comprises a pad of electrically conductive material disposed at each of a first and a second end portion of said second substrate, and a fusible element disposed between and electrically connecting said pads, said means for electrically connecting said first fuse element to the end termination at said first end portion comprises a conductor disposed in a hole extending through the first substrate to the end termination, and said means for electrically connecting said second fuse to the end termination at the second end portion comprises a conductor disposed in a hole extending through the second substrate and the first substrate to the end termination.

25. The chip fuse as claimed in claim 24, wherein a bottom surface of the first and second end portions of the first substrate includes metallized layers to facilitate electrical connection between the conductors and the end terminations.

26. The chip fuse as claimed in claim 18, wherein the end terminations each comprise an inner layer of silver/silver alloy, a middle layer of nickel and an outer layer of tin/lead containing material.

* * * * *